United States Patent [19]

Grumblatt

[11] 3,976,326

[45] Aug. 24, 1976

[54] HINGE

[75] Inventor: Victor J. Grumblatt, Cape Canaveral, Fla.

[73] Assignee: Lord Corporation, Erie, Pa.

[22] Filed: Aug. 6, 1975

[21] Appl. No.: 602,356

[52] U.S. Cl. ..... 297/333
[51] Int. Cl.[2] ..... A47C 1/02
[58] Field of Search ..... 297/333; 248/374, 375

[56] References Cited

UNITED STATES PATENTS

| | | | |
|---|---|---|---|
| 2,201,450 | 5/1940 | Nordmark | 297/333 |
| 2,280,298 | 4/1942 | Nordmark | 297/333 |
| 2,460,596 | 1/1949 | Roche | 248/374 X |
| 2,572,145 | 10/1951 | Hendricks | 297/333 |

*Primary Examiner*—James C. Mitchell
*Attorney, Agent, or Firm*—Maurice R. Salada

[57] ABSTRACT

A hinge comprises a first and a second bracket that are at least partially spaced apart. A viscoelastic member is disposed between and secured to the brackets to permit relative rotation between them about an axis that passes through both brackets and the viscoelastic member. At least one of the brackets includes a stop engagable with the other bracket to prevent rotation of the first bracket relative to the second bracket about the axis of rotation in one direction beyond a predetermined relative orientation of the two brackets. Relative rotation between the brackets when the stop is engaging the other bracket occurs about a second rotational axis spaced from the first axis and passing through a point of contact between the stop and the other bracket.

8 Claims, 8 Drawing Figures

HINGE

In a theater, an auditorium, a stadium or a similar facility having rows of chairs or seats fixed to a floor, it is commonly desired to provide the maximum number of chairs or seats while maintaining the distance between rows required by fire and safety ordinances. An effective method of maximizing seating capacity is to design the chairs or seats with seat portions which will project into the between-rows aisle space when the chairs are occupied. When the chairs or seats are vacated, the seat portions must automatically retract or swing into upwardly angled and out-of-the-way positions. The upwardy angled positions of the seat portions facilitate both the entrance and exit of persons from the facility and the cleaning of the facility. A conventional method of insuring that the seat portions of chairs or seats will automatically return to upwardly angled positions when not in use is to construct the hinges for the seat portions utilizing bodies of resilient material which are stressed in torsion or twisted when the chairs or seats are occupied. When the occupants of the chairs or seats arise, the bodies of resilient material untwist and thereby swing the seat portions of the chairs into upwardly angled positions. The structure and operation of one such seat hinge utilizing a body of resilient material is described and illustrated in Nordmark U.S. Pat. No. 2,280,298. Other, generally similar seat hinge structures are described and illustrated in Nordmark U.S. Pat. No. 2,201,450 and Hendrickson U.S. Pat. No. 2,572,145.

As is best shown in the Nordmark '298 patent, a seat hinge utilizing a body of resilient material may be constructed to provide not merely two operational positions of the seat portion of an auditorium chair or seat, but may accommodate three distinct operational positions. Specifically, the hinge of the Nordmark '298 patent permits the seat portion of an "opera" seat to assume a generally horizontal position when occupied, an upwardly angled position when unoccupied, and a nearly vertical or upright position when the occupant of the seat stands up to let someone else pass by and pushes the seat portion back beyond its "unoccupied" position. The body of resilient material in each hinge that mounts the seat portion of a Nordmark seat on an adjacent side support or standard member is loaded in torsion when the seat is occupied and is unloaded when the seat is unoccupied. The resilient material is also loaded in torsion, in a direction opposite that in which the material is loaded when the seat is occupied, to accommodate the nearly vertical position of the seat portion of the seat.

A hinge such as that shown in the Nordmark '298 patent is relatively quiet in operation and is convenient because it permits the seat portion of a chair or seat to assume three distinct positions. Nonetheless, the operation of the Nordmark hinge, whereby the body of resilient material is loaded in one direction when the seat is occupied and in the opposite direction when the seat portion of the seat assumes a nearly vertical or upright position, tends to have an adverse effect on the useful life of the resilient material. The service life of the hinge of the Nordmark patent may be noticeably reduced as compared to similar hinges which accommodate only two operational positions of the seat portion of a chair or seat and which permit their incorporated resilient material to be loaded torsionally in one rotational direction only. In addition, the seat hinge of the Nordmark '298 patent suffers from an infirmity common to all hinges utilizing bodies of resilient material. The resilient material takes a permanent "set" after repeated occupations of the chair or seat (i.e. repeated loads on the material). The hinge then ceases to return the seat portion of the seat to the intended position when the seat is unoccupied. The set in the resilient material permits the seat portion of the chair or seat to droop and project into the adjacent between-rows aisle, which reduces the aisle space available for persons passing in front of the seat. As a result, the bodies of resilient material in the hinges, and possibly the complete hinge assemblies, may have to be replaced even though the resilient material has not been physically damaged and may still theoretically have a significant remaining life.

SUMMARY OF THE INVENTION

The present invention is directed to a hinge incorporating a body of resilient viscoelastic material which is particularly suitable for use in chairs or seats for theaters, auditoriums, stadiums and similar facilities. The hinge permits the seat portion of a chair or seat to assume three distinct operating positions (i.e. "occupied", "unoccupied" and "upright") with at least a substantial reduction in the exposure of the resilient viscoelastic material in the hinge to detrimental "reversal" loading. The hinge also permits an initial compensation to be made for the set to be expected in the resilient viscoelastic material during the life of the hinge.

According to the invention, the hinge comprises a first and a second bracket member which are at least partially spaced from each other. A viscoelastic member is disposed between and secured to the bracket members to permit relative rotation between them about an axis that passes through both bracket members and the viscoelastic member. At least one of the bracket members has a stop device engagable with the other bracket member to prevent rotation of the first bracket member relative to the second bracket member about the rotational axis in one direction beyond a predetermined relative orientation of the two bracket members. When the bracket members are in this predetermined relative orientation, the seat portion of a chair or seat associated with the hinge would be in an unoccupied position. Relative rotation between the two bracket members when the stop device on the one member is engaging the other member occurs about a second axis of rotation spaced from the first rotational axis and passing through a point of contact between the stop device and the other bracket member. Thus, rotation of the seat portion of an associated seat into an upright position from an unoccupied position would occur about the second rotational axis, rather than about the first axis of rotation. Reverse torsional loading of the viscoelastic member is thereby substantially avoided. Since rotational movement about a second axis, rather than linear translational movement, is involved, however, some reverse torsional loading may be experienced by the viscoelastic member.

In a preferred embodiment of the hinge, the two rotational axes are parallel. The two bracket members and the viscoelastic member are secured together and oriented relative to each other such that when the two bracket members assume their predetermined relative orientation and the stop device on the one member is engaging the other member, the viscoelastic member remains stressed in torsion to a limited extent. Such prestressing of the viscoelastic member, when the hinge is in its nominal unoccupied position effectively compensates for the set to be experienced in the viscoelastic member during its future use. The ability to provide such prestressing of the viscoelastic member arises from the use of two different axes of rotation to accommodate relative movement of the bracket members between their unoccupied and occupied relative orientations and between their unoccupied and upright relative orientations.

The preferred form of the hinge includes a stop mechanism on each of the bracket members which specifically comprises at least two spaced lugs on a rigid base portion of each bracket member. At least one lug on each base portion engages a lug on the other base portion when the two bracket members rotate into their unoccupied relative orientation. In addition, one lug on each base portion is engagable with a lug on the other base portion to prevent rotation in the opposite direction of the first bracket member relative to the second bracket member about the first axis of rotation beyond a second predetermined relative orientation of the two bracket members. In other words, the lugs engage to prevent the seat portion of a seat associated with the hinge from rotating downwardly beyond the designated occupied position.

BRIEF DESCRIPTION OF THE DRAWINGS

For a better understanding of the invention, reference may be made to the following description of two exemplary embodiments, taken in conjunction with the figures of the accompanying drawings, in which.

DESCRIPTION OF PREFERRED EMBODIMENTS

Figure 1:
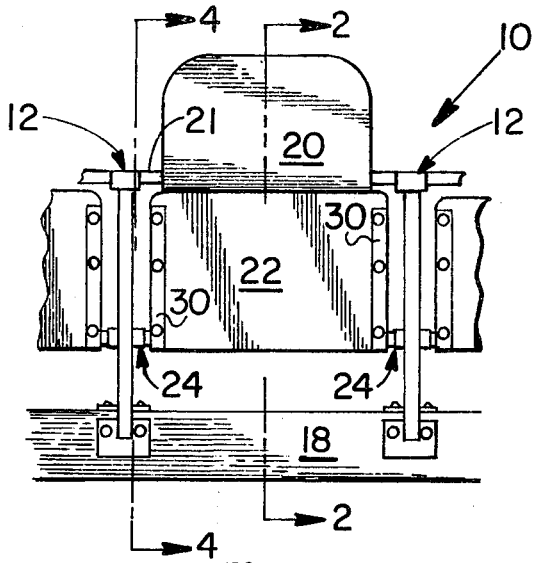
FIG. 1 is a fragmentary front view of a row of stadium seats, the seat portions of which are hinged on adjacent side supports or standard members utilizing hinges according to the present invention.

FIG. 1 of the drawings illustrates a part of a row of identical seats or chairs for a stadium, amphitheater or similar facility. The centrally located seat will be described in detail hereinafter and is generally designated with the reference numeral 10. The seat 10 comprises a pair of vertically oriented, parallel side supports or standard members 12 that are spaced apart the approximate width of the seat. The side supports 12 are preferably formed of a strong, rigid material, such as steel or aluminum. Each side support 12 comprises a generally horizontal arm rest 14 and a pair of vertically depending and spaced apart rails 16 and 17. The lower end of each of the rails 16 and 17 is rigidly secured to a base supporting structure 18 for the seat 10. In the illustrated embodiment, the supporting structure 18 is one of a series of concrete steps in a stadium.

Figure 2:
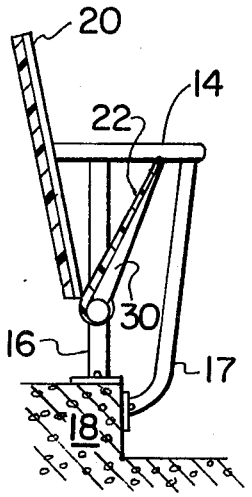
FIG. 2 is a sectional view of one of the unoccupied seats of FIG. 1 taken along line 2—2 of FIG. 1.

Disposed between the side supports 12 is the back portion 20 of the seat 10. The back portion 20 is inclined at a slight angle to the vertical and slopes from bottom to top away from the front of the seat 10. The back portion 20 is rigidly attached to a traverse member 21 extending between the side supports 12 adjacent the arm rests 14. The seat portion 22 of the seat 10 is also disposed between the side supports 12 and is rotatably mounted on the upright rails 16 of the side supports adjacent the lower end of the back portion 20 of the seat. A pair of hinges 24, constructed according to the present invention, connect the seat portion 22 to the rails 16. The seat portion 22 of the seat 10 is shown in FIGS. 1 and 2 of the drawings in its normal position when the seat is unoccupied. Both the back and the seat portions of the seat 10 are preferably formed of plastic, wood, or some other lightweight, durable and low maintenance material.

Figure 3:
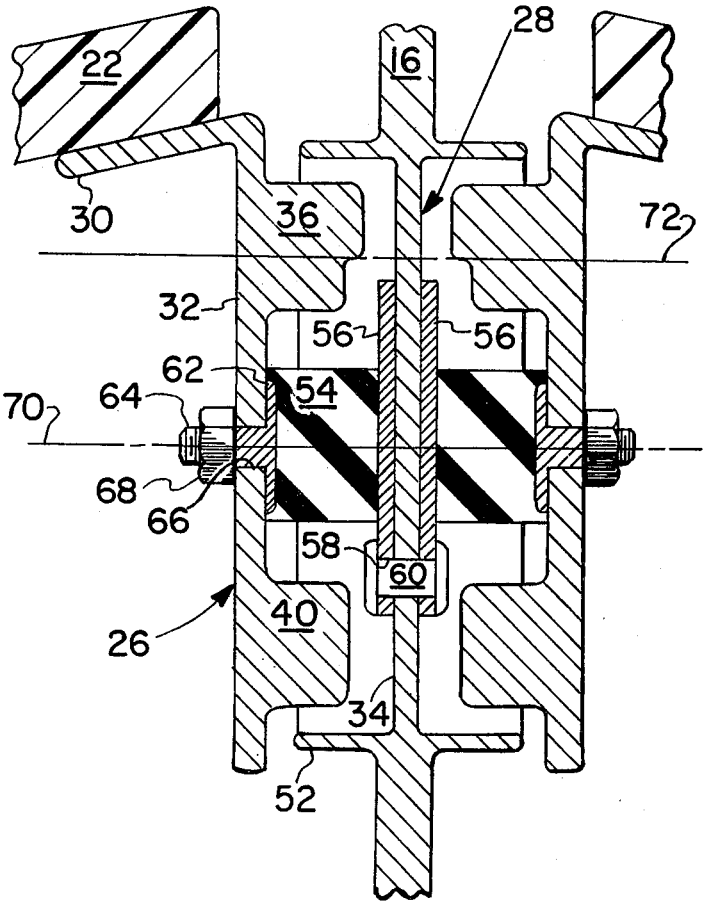
FIG. 3 is a sectional view of a pair of adjacent hinges according to the present invention taken along line 3—3 of FIG. 4.

As shown in FIG. 3, each hinge 24 comprises a pair of generally parallel bracket members 26 and 28. In the embodiment of FIGS. 1 to 3, the bracket 26 is a circular enlargement formed at the larger end of a tapered metal support 30, which is secured to and supports one edge of the seat portion 22 of the seat 10. The bracket 28 is a circular enlargement formed in the adjacent side support rail 16. The brackets 26 and 28 may also be separate members secured to the seat portion 22 and the rail 16, as in the embodiment of the invention illustrated in FIGS. 7 and 8 of the drawings. Circular base portions 32 and 34 of the brackets 26 and 28, respectively, are parallel, concentric and spaced apart.

Figure 4:
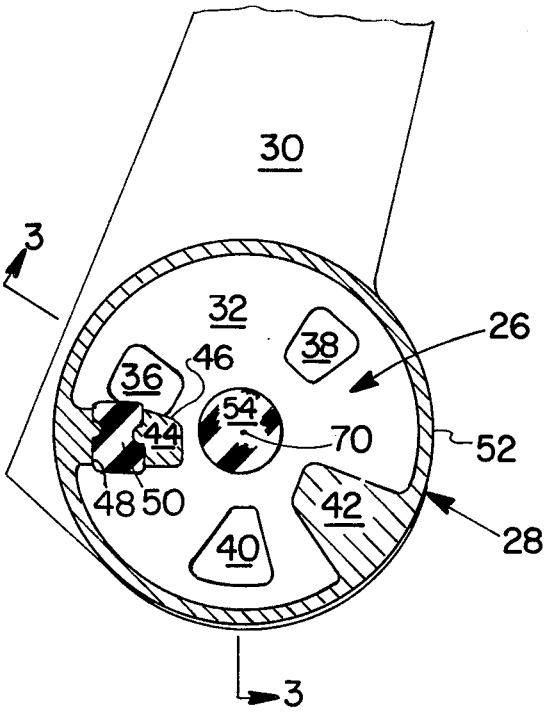
FIG. 4 is a fragmentary view, on an enlarged scale, of a portion of the seat illustrated in FIG. 2, taken along line 4—4 of FIG. 1.

As best shown in FIG. 4, three lugs 36, 38 and 40 protrude from the base portion 32 of the bracket 26 toward the base portion 34 of the bracket 28 and are disposed at generally equal distances from the center of the base portion 32. Each of the lugs 36 and 38 has a tapered configuration defined by a pair of radii extending from the center of the base portion 32. The lug 40 also has a tapered configuration but only one tapered side is defined by a radius from the center of the base portion 32, for a reason that will become apparent. The base portion 34 of the bracket 28 similarly has two lugs 42 and 44 that project toward the bracket 26 and are disposed at generally equal distances from the center of the base portion. The lug 42 has a tapered configuration defined by a pair of radii extending from the center of the base portion 34. The lug 44 has a generally rectangular configuration with a tapered corner 46 defined by a radius from the center of the base portion 34. In its surface presented to the bracket 26, the lug 44 has a contoured slot 48 that receives a similarly configured block of resilient material 50, such as rubber. The slot 48 in the lug 44 has a paired of raised lands which engage corresponding grooves in the body of resilient material 50 to hold the body in place and prevent shifting. A similar block of resilient material may also be mounted in the lug 42. An annular flange 52 on the base portion 34 effectively encircles all of the projecting lugs, 36, 38, 40, 42 and 44 when the two brackets 26 and 28 are assembled together.

Interposed between the adjacent surfaces of the base portions 32 and 34 of the brackets 26 and 28 is a cylinder of viscoelastic material 54. The viscoelastic material 54 may be natural or synthetic rubber or any one of a number of other materials such as plasticized polyvinyl acetate, polystyrene and polyvinyl chloride. It may also be formed in shapes other than a cylinder. At one end, the cylinder of viscoelastic material 54 is secured, by vulcanization or adhesive bonding, for example, to a plate 56. The plate 56 has a pair of diametrically opposed openings 58 (only one of which is shown due to the manner in which FIG. 3 is taken) that are aligned with corresponding holes in the bracket 28. A fastener 60, such as a pop rivet or a bolt, passes through each hole 58 in the plate 56, a corresponding hole in the bracket 28, and, if desired, through a hole in a similar plate 56 on the opposite side of the rail 16. The fastener 60 thus secures the cylinder of viscoelastic material 54 to the bracket 28 and, hence, to the rail 16. The other end of the cylinder of viscoelastic material 54 is bonded to an annular flange 62 that projects radially from one end of a threaded shaft 64. The shaft 64 passes through a hole 66 in the center of the bracket 26 and a nut 68 is screwed onto the end of the shaft to hold the cylinder of viscoelastic material 54 on the bracket.

The brackets 26 and 28 and the cylinder of viscoelastic material 54 of each hinge 24 are assembled in the relative orientation shown in FIGS. 3 and 4. The assembled orientation of the hinge components will maintain the seat portion 22 of the seat 10 in an unoccupied position, as shown in FIGS. 1 and 2. The lug 42 of bracket 28 is interposed between and spaced circumferentially from the lugs 38 and 40 of bracket 26. The lug 44 of bracket 28 is similarly interposed between lugs 36 and 40 of bracket 26 and is spaced circumferentially from the lug 40. The longitudinal axis of the viscoelastic body 54 is aligned with the centers of the circular base portions 32 and 34 of brackets 26 and 28, respectively. The bracket 26 is thus capable of rotating relative to the bracket 28 to a limited extent about an axis 70 that is coincident with the longitudinal axis of the body of viscoelastic material 54 and with the centers of brackets 26 and 28. The relative rotation is normally achieved by torsional loading or twisting of the viscoelastic body 54, as will be described hereinafter. The rotation is limited by the interfering relationships of the various lugs 36, 38, 40, 42 and 44, which are all disposed at generally the same radial distance from the rotational axis 70. The cylinder of viscoelastic material 54 is slightly twisted during assembly and is held in a twisted condition by the engagement of the lug 36 on the bracket 26 with the lug 44 on the bracket 28. The initial twisting of the material 54 produces a small torsional preload on the material. The preload tends to urge the seat portion 22 of the seat 10 into a more upright position and maintains the lugs 36 and 44 in close contact.

Figure 5:
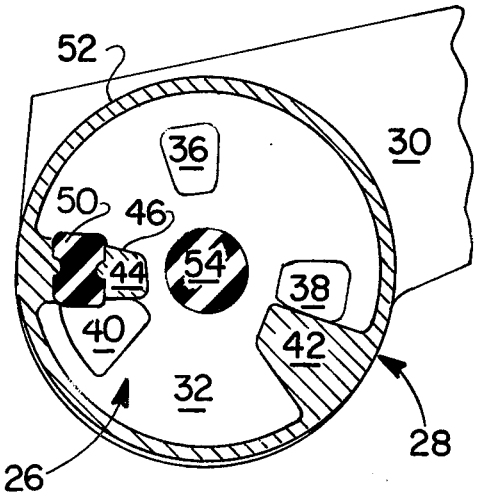
FIG. 5 is a view corresponding to FIG. 4 but illustrating the seat portion of the stadium seat of FIG. 2 in an occupied position.

As a person sits down on the seat 10, he rotates the seat portion 22 through an angle of approximately 55° about the axis 70 from its unoccupied position, shown in FIG. 4, to a generally horizontal occupied position, as shown in FIG. 5. In reaching the position shown in FIG. 5, the lug 36 on the bracket 26 of the hinge 24 illustrated in FIGS. 4–6 rotates in a clockwise direction away from the lug 44 on the bracket 28. At the same time, the lugs 38 and 40 on the bracket 26 rotate in a clockwise direction to engage the lugs 42 and 44, respectively, of the bracket 28. The lug 40 initially engages the block of resilient material 50 carried by the lug 44, in order to cushion the impact of the respective lugs, before there is metal-to-metal contact between the lugs 40 and 44 or between the lugs 38 and 42. In the occupied relative orientation of the brackets 26 and 28 shown in FIG. 5, the cylinder of viscoelastic material 54 is loaded in torsion or twisted. The seat portion 22 of the seat 10 is firmly supported by the engagement of the lugs 38 and 42 and the lugs 40 and 44. The tapering of the lugs 38 and 42 along radii from the axis 70 insures full, rather than line contact, between the engaging surfaces of the lugs. Similar, full contact occurs between the adjacent surfaces of lugs 40 and 44 since the side of the lug 40 which is not defined by a radius from the center of the base portion 32 or axis 70 engages the similarly non-radial side of the lug 44.

When the occupant of the seat 10 stands up, the load on the cylinder of viscoelastic material 54 is removed (except for the static load of the seat portion 22 of the seat 10) and the viscoelastic material is free to untwist. The untwisting or flexing of the viscoelastic material 54 rotates the seat portion 22 to the unoccupied position illustrated in FIG. 4. As the seat portion 22 of the seat 10 rises, the lug 36 on the bracket 26 initially engages the block of resilient material 50 in the lug 44 of the bracket 28. The resilient material 50 cushions engagement of the lugs 36 and 44. As the material 50 deflect, the lug 36 contacts the radially oriented surface of the tapered corner 46 of the lug 44. The remaining lugs 38, 40 and 42 of the brackets 26 and 28 do not engage one another. In this unoccupied relative orientation of the brackets 26 and 28, the cylinder of viscoelastic material 54 remains slightly twisted and is subject to a torsional preload, as discussed above. Although not shown, the static load of the seat portion 22 of the seat 10 may produce a slight shear deflection of the viscoelastic cylinder 54. The damping afforded by the viscoelastic material reduces bouncing of the seat portion 22 as the lugs 36 and 44 initially come into contact.

Figure 6:
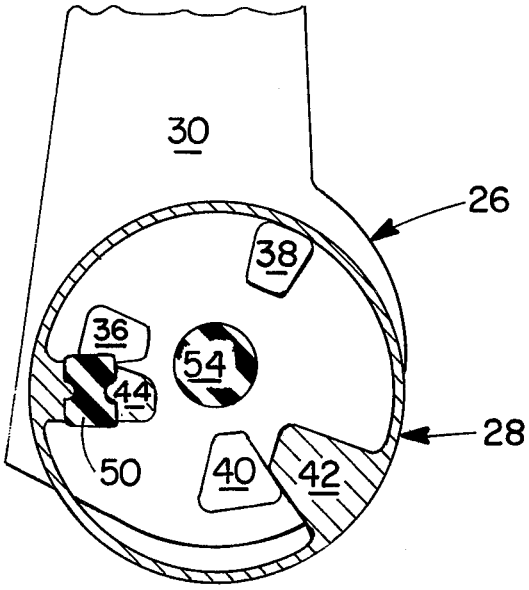
FIG. 6 is a second view corresponding to FIG. 4 but showing the seat portion of the stadium seat of FIG. 2 in an upright position.

If the occupant of the seat 10 stands up to let someone else pass by, for example, the seat portion 22 of the seat may be pushed back beyond its unoccupied position to a more nearly vertical position. As can be seen in FIG. 4, however, additional counter-clockwise rotation of the seat portion 22 and the bracket 26 about the axis 70 is prevented by the contact between the lug 36 and the angled corner 46 of the lug 44. Consequently, as a force is applied in a counter-clockwise direction to the end of the seat portion 22 of the seat 10, the seat portion will tend to rotate about an axis 72 passing through the radially outermost (relative to the axis 70) point of contact between the radially oriented surfaces of the lugs 36 and 44. Since rotation no longer occurs about the central axis 70, the circular base portions 32 and 34 of the two brackets 26 and 28 will pivot away from their concentric alignment, as is shown in FIG. 6 of the drawings, and the cylinder of viscoelastic material 54 will be stressed primarily in shear, rather than in torsion. The counter-clockwise rotation of the seat portion 22 will be halted by engagement of the lug 40 with the lug 42, engagement of the lug 38 with the flange 52, and engagement of the side of the lug 36 with the adjacent, non-radial surface of the lug 44. The effective stiffness of the viscoelastic material 54 in "shear" about the second axis 72 will be greater than the stiffness of the material in torsion about its central axis 70 by a factor that increases as the spacing increases between the axis 72 and the central axis 70. The stiffness differential helps prevent the torsional preload on the cylinder 54 from causing rotation about the axis 72 without an external force on the seat portion 22 of the seat 10.

As can be seen from the foregoing description and from FIGS. 1 to 6 of the drawings, the hinge of the present invention effectively utilizes the torsional loading of a body of viscoelastic material to provide a quiet and automatic return of the seat portion of a seat from an occupied to an unoccupied position. The hinge of the invention also permits the seat portion of a seat to be pushed back beyond its unoccupied position to a more nearly upright position, but does so with at least substantially reduced reverse torsional loads on the body of viscoelastic material that provides the automatic return function. The body of viscoelastic material is stressed essentially in shear as the seat portion of the seat is rotated about a second axis of rotation located entirely outside the body of viscoelastic material. In addition, since the body of viscoelastic material is not loaded in two opposed directions about a single axis, a torsional preload can be imposed on the viscoelastic body without interferring with the ability of the hinge to accommodate rotation of the seat portion of the seat to a position more nearly upright than the unoccupied position. The preload will compensate for the set experienced by the viscoelastic material after a long period of use so that the tendency of the seat portion to return to its designated unoccupied position will be maintained despite the set in the viscoelastic material.

Figure 7:
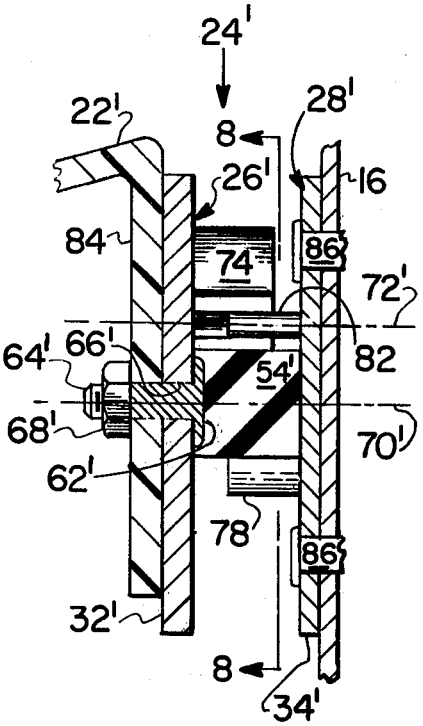
FIG. 7 is a view corresponding to FIG. 3 but illustrating an alternate embodiment of the hinge of the present invention.
Figure 8:
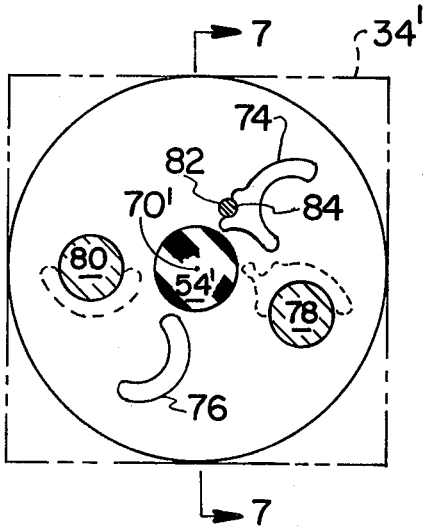
FIG. 8 is a view corresponding to FIG. 4 and taken along view line 8—8 of FIG. 7.

FIGS. 7 and 8 of the drawings illustrate a second embodiment 24′ of the hinge of the present invention. In the hinge 24′, a pair of spaced apart bracket members 26′ and 28′ are joined together by a cylindrical body of viscoelastic material 54′. The bracket 26′ includes a circular base portion 32′ and a pair of arcuate lugs 74 and 76 which project from the base portion toward the bracket 28′. The bracket 28′ has a square base portion 34′ and a pair of cylindrical lugs 78 and 80 and a pin 82 which all project from the base portion toward the bracket 26′. One end of the viscoelastic cylinder 54′ is secured, either by vulcanization or adhesive bonding, for example, directly to the center of the adjacent surface of the base portion 34′ of the bracket 28′. The bracket member 28′ is secured to the adjacent rail 16 of the side support 12 by a pair of fasteners 86, such as pop rivets, passing through aligned openings in the bracket member 28′ and the rail 16. The other end of the viscoelastic cylinder 54′ is secured to an annular flange 62′ that projects radially from one end of a threaded shaft 64′. The shaft 64′ passes through an opening 66′ in the center of the bracket 26′ and through an aligned hole in a flange 84 depending from and integral with the seat portion 22′ of the seat. The flange 84 performs the functions of support 30 of FIGS. 1–6. By screwing a nut 68′ on the threaded shaft 64′ not only is the cylinder of viscoelastic material 54′ secured to the bracket member 26′, but the bracket member 26′ is also secured to the seat portion 22′ of the seat.

When the seat portion 22′ of the seat of the embodiment of FIGS. 7 and 8 is in the unoccupied position, the lug 74 on the bracket 26′ engages the pin 82 of the bracket 28′ in a detent 84 formed on the convex surface of the arcuate lug 74. The remaining lugs 76, 78 and 80 are not engaged. As in the embodiment of FIGS. 1 to 6, the cylinder 54′ of viscoelastic material is under a small torsional preload when the seat portion 22′ is in an unoccupied position. When the seat is occupied, the bracket 26′ rotates in a clockwise direction about a central axis 70′ until the arcuate lugs 74 and 76 engage the cylindrical lugs 78 and 80, respectively, of the bracket member 28′, as shown in phantom in FIG. 8. The engagement between the lugs 74 and 78 and the lugs 76 and 80 limits further downward movement of the seat portion 22′ of the seat. When the occupant of the seat stands up, the load on the body of viscoelastic material 54′ is removed and the viscoelastic material is free to untwist. The untwisting or flexing of the viscoelastic material 54′ rotates the seat portion 22′ of the seat to its unoccupied position and the two brackets 26′ and 28′ into an unoccupied relative orientation as shown in full in FIG. 8.

When an occupant of the seat of FIGS. 7 and 8 stands up to let someone else pass by, the seat portion 22′ may be pushed back beyond its unoccupied position to a more nearly upright position. Due to the engagement of the lug 74 and the pin 82, counter-clockwise rotation of the seat portion 22′ beyond the unoccupied position occurs about the longitudinal centerline 72′ of the pin 82. During such rotational movement, the two bracket members 26′ and 28′ pivot away from their normally concentric alignment and the body of elastomer 54′ is loaded essentially in shear, rather than in torsion.

It will be understood that the embodiments described above are merely exemplary and that persons skilled in the art may make many variations and modifications without departing from the spirit and scope of the invention. All such modifications and variations are intended to be within the scope of the invention as defined in the appended claims.

What is claimed is:

1. A hinge comprising:

a. first bracket means;

b. second bracket means at least partially spaced from the first bracket means; and c. viscoelastic means disposed between and secured to both bracket means to permit relative rotation between the first and second bracket means about a first axis that passes through said viscoelastic means and both bracket means, at least one of the first and second bracket means including stop means engageable with the other of the first and second bracket means to prevent rotation of the first bracket means relative to the second bracket means about the first axis in one direction beyond a predetermined relative orientation of the two bracket means, relative rotation between said two bracket means when the stop means is engaging the other of the first and second bracket means occuring about a second axis spaced from the first axis and passing through a point of contact between the stop means and the other bracket means.

2. A hinge, according to claim 1, wherein the second axis is parallel to the first axis.

3. A hinge, according to claim 1, wherein the viscoelastic means is stressed in torsion during relative rotation between the bracket means about the first axis and wherein the two bracket means and the viscoelastic means are secured together and oriented relative to each other such that when the two bracket means assume their predetermined relative orientation and the stop means is engaging the other bracket means, the viscoelastic means remains stressed in torsion.

4. A hinge, according to claim 1, wherein the other of the first and second bracket means also includes stop means and wherein the stop means of the first bracket means engages the stop means of the second bracket means when the two bracket means assume their predetermined relative orientation.

5. A hinge, according to claim 4, wherein each of the first and second bracket means includes a rigid base portion and wherein each of the stop means includes at least two spaced lugs on a corresponding base portion, at least one lug on each base portion engaging a lug on the other base portion when the two bracket means assume their predetermined relative orientation, at least one lug on each base portion being engagable with a lug on the other base portion to prevent rotation of the first bracket means relative to the second bracket means about the first axis in a direction opposite said one direction and beyond a second predetermined relative orientation of the two bracket means.

6. A hinge, according to claim 1, wherein the viscoelastic means includes a generally cylindrical body of viscoelastic material, the first axis being coincident with the longitudinal axis of the viscoelastic body and the second axis being located entirely outside the viscoelastic body.

7. A hinge comprising:

a. first bracket means including a first rigid base portion and a lug on said base portion;

b. second bracket means including a second rigid base portion and a lug on the second base portion, at least a part of the second base portion being spaced from and oriented generally parallel to a corresponding part of the first base portion, and c. connecting means disposed between and secured to the spaced parts of the fist and second base portions, the connecting means including a body of viscoelastic material that flexes in torsion to permit relative rotation between the two bracket means about a first axis that passes through the viscoelastic body and both bracket means, the lug on the first base portion being engagable with the lug on the second base portion to prevent rotation of the first bracket means relative to the second bracket means about the first axis in one direction beyond a predetermined relative orientation of the two bracket means, the engagement between said lugs of the first and second base portions and the flexibility of the viscoelastic material being such as to permit when said lugs are engaged relative rotation between the two bracket means about a second axis generally parallel to and spaced from the first axis and passing through a point of contact between said lugs.

8. In a chair or like article having a pair of spaced apart, generally parallel side supports, a back portion disposed between the side supports and secured to each support, and a seat portion also disposed between the side supports and rotatably mounted on each support as to be movable between a first position more nearly perpendicular than parallel to the back portion and a second position more nearly parallel to the back portion than said first position, the improvement of at least one hinge rotatably securing the seat portion of the chair to an adjacent side support, said hinge comprising:

a. first bracket means secured to the seat portion of the chair;

b. second bracket means secured to said adjacent side support, the second bracket means being oriented generally parallel to and at least partially spaced from the first bracket means, and c. viscoelastic means disposed between and secured to both bracket means to permit relative rotation between the first and second bracket means about a first axis that passes through said viscoelastic means and both bracket means, at least one of the first and second bracket means including stop means engageable with the other of the first and second bracket means to prevent rotation of the first bracket means and the seat portion of the chair relative to the second bracket means and the back portion of the chair about the first axis in a direction from the first position of the seat portion toward the second position of the seat portion and beyond a predetermined relative orientation of the two bracket means, said predetermined relative orientation of the bracket means defining a corresponding orientation of the seat portion of the chair which is closer to its second position than to its first position, relative rotation between said two bracket means and between the seat portion and the back portion of the chair when the stop means is engaging the other of the first and second bracket means occuring about a second axis spaced from the first axis and passing through a point of contact between the stop means and the second bracket means.

* * * * *